United States Patent [19]

Danner

[11] 4,265,470

[45] May 5, 1981

[54] TUBULAR CONNECTOR

[75] Inventor: Bailey L. Danner, Houston, Tex.

[73] Assignee: Cameron Iron Works, Inc., Houston, Tex.

[21] Appl. No.: 77,643

[22] Filed: Sep. 21, 1979

[51] Int. Cl.[3] ..... F16L 21/08; F16L 37/12

[52] U.S. Cl. ..... 285/39; 285/89; 285/319; 285/322

[58] Field of Search ..... 285/322, 319, 39, 89

[56] References Cited

U.S. PATENT DOCUMENTS

| | | | |
|---|---|---|---|
| 1,001,069 | 8/1911 | Nielsen | 285/322 X |
| 3,394,950 | 7/1968 | Jensen | 285/322 X |
| 4,093,281 | 6/1978 | Jansen, Jr. | 285/39 |
| 4,124,229 | 11/1978 | Ahlstone | 285/18 |
| 4,124,231 | 11/1978 | Ahlstone | 285/322 X |

FOREIGN PATENT DOCUMENTS

| | | | |
|---|---|---|---|
| 1310713 | 10/1962 | France | 285/322 |

*Primary Examiner*—Thomas F. Callaghan
*Attorney, Agent, or Firm*—Vinson & Elkins

[57] ABSTRACT

A tubular connector or riser connector having a pin section and a box section, a collet surrounding said sections and engaging a shoulder on one of said sections and having a plurality of fingers with internal ridges engaging with external ridges on the other section when the connector is sufficiently preloaded. A lock ring and lock nut are used to retain the collet fingers in engaged position.

6 Claims, 2 Drawing Figures

TUBULAR CONNECTOR

BACKGROUND OF THE INVENTION

Oil and gas wells are now being drilled in water which is so deep that fixed drilling platforms are not suitable and floating platforms are used. These floating drilling platforms have some movement responsive to wind, waves and current. Current also acts on the drilling conduit or riser. With drilling proceeding in relatively deep water, the riser due to its increased length and resulting greater weight must be tensioned at the drilling vessel as well as buoyed along its length to prevent buckling. The movement of the drilling vessel and the current forces on the riser create dynamic loads on the riser which produce alternating stresses therein.

Prior riser connectors are preloaded at initial make-up but the preloading is not sufficient to avoid wear of mating parts as a result of movement. The life of present riser connectors is greatly shortened by the combination of the alternating stresses on the riser connector and its stress concentration factors. Another disadvantage experienced by prior preloaded riser connectors is that they have been extremely heavy and expensive. In certain of these riser connectors extremely high preloads are used to accommodate the high thermal gradients resulting from hot fluids in the riser and cooler seawater around the riser which tend to relieve the preload. Also, large oil flow lines have high thermal gradients in which loaded connectors are desirable, particularly a connector in which the thermal gradients do not relieve the preload.

The Luke et al U.S. Pat. No. 4,012,059 discloses a pipe connector having telescoping tubular members with one of the members being stretchable to preload the latch means. The latches include a plurality of ring segments which engage in grooves between the two members to retain them in loaded position. The J. Moon U.S. Pat. No. 2,485,763 discloses a tool joint and collar assembly which includes fingers engaging on a shoulder and a sleeve or collar which slides onto the fingers to hold them in engaged position. The Van Bilderbeek et al U.S. Pat. No. 4,074,912 discloses a rigid pile connector which includes a ring engaged by a plurality of buttons from one member, and a plurality of fingers engaging an internal shoulder on the other member with the interior of the fingers held in place by a removable sleeve.

Preloaded connectors are shown in the Jansen U.S. Pat. No. 4,093,281 and the Ahlstone U.S. Pat. No. 4,124,229 which disclose the use of hydraulic cylinders for preloading the joint. Jansen suggests threading a reaction nut against the members during loading to retain the loading after the cylinders are released. Ahlstone provides a pressure energized shrink fit.

SUMMARY

The present invention relates to an improved riser connector or tubular connector which can be preloaded. This improved connector includes pin and box ends on the adjacent tubular sections, and external shoulder on the box end, buttress ridges on the pin, a collet having a shoulder to engage the box shoulder and a plurality of fingers with buttress ridges to engage the pin ridges when loaded and means to retain the fingers in engaged position.

An object of the present invention is to provide an improved tubular connector particularly suitable as a riser connector which is preloaded and has a minimum number of parts, minimizes the effects of alternating stresses, has no extra weight over prior connectors and will benefit from any thermal gradients rather than having its preload released.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

Figure 1:
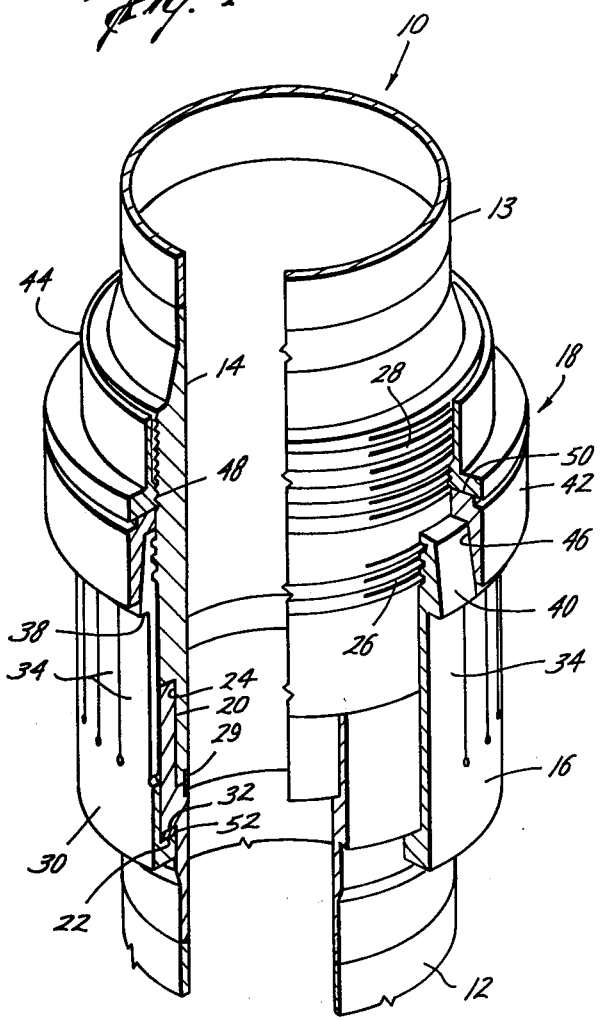
FIG. 1 is an isometric perspective view of the improved tubular connector of the present invention shown as a riser connector with portions broken away and shown in section to show the assembled relationships of the joint.
Figure 2:
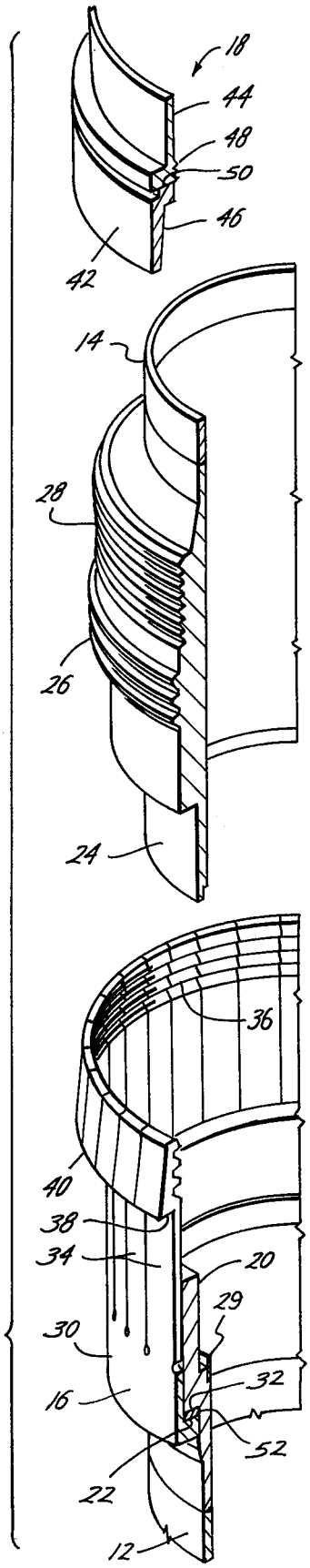
FIG. 2 is an exploded partial of the riser connector shown in FIG. 1.

Improved riser connector 10 includes riser sections 12 and 14, collet 16 and retaining means 18. Riser section 12 includes box 20 and external shoulder 22 facing downwardly as shown. Riser section 14 includes pin 24, straight cut external buttress profiles or ridges 26 and external threads 28 positioned farther from pin 24 than ridges 26. Seal ring 29 of the "AX" type is used to provide a metal-to-metal seal between pin 24 and box 20.

Collet 16 includes ring 30 having internal shoulder 32 which is adapted to engage shoulder 22 and fingers 34 extending toward ridges 26. Straight cut internal buttress profiles or ridges 36 are formed on the interior of fingers 34. Ridges 36 are formed to mate with ridges 26. External shoulder 38 on the exterior of fingers 34 faces downwardly. As shown in the drawings, collet 16 surrounds section 12 and when connector 10 is loaded, finger ridges 36 engage ridges 26 on section 14. Exterior surfaces 40 on fingers 34 taper inwardly toward the end of fingers 34 away from ring 30.

Retaining means 18 includes lock ring 42 and lock nut 44. Lock ring 42 has internal annular surface 46 tapered in the same direction and at the same angle as the taper on surfaces 40. These tapers preferably have a cone angle of approximately 8° to be a self-locking taper. Lock nut 44 has internal threads 48 which mate with threads 28.

Collet 16 is slipped on section 12 before it is welded to riser 13. Section 14 is positioned with its pin 24 inserted into box 20. Lock ring 42 and lock nut 44 are assembled on section 14 before it is welded to upper riser 13. Connector 10 is assembled by placing collet 16 on box section 12 with shoulders 22 and 32 in engagement. Load is applied with a suitable loading device (not shown) by support of shoulder 38 on collet 16 and application of a load to the section 14 as by loading outer end of lock nut 44, lock nut 44 being engaged against threads 28 but not threaded thereon. The load places section 14 under compression and places collet fingers 34 in tension when ridges 36 on fingers 34 become interengaged with ridges 26. Then lock ring 42 is slipped over fingers 34 and lock nut 44 threaded onto threads 28 to retain collet fingers 34 in such engagement. The length of riser section 14 from its pin end 24 to ridges 26 is preselected or shims 52 are provided between shoulders 22 and 32 so that the preselected preload is used to bring finger ridges 36 into engagement with ridges 26 on section 14.

This preload slightly compresses section 14 and to a much greater extent stretches fingers 34 since they are preferably of smaller cross-section than section 14. With an 18⅝ inch diameter, 3000 psi riser it is preferred that the preload on the riser connector be approximately 1,500,000 pounds. The ratio of pin stiffness to collet or box stiffness together with the preloading of the connector to a higher value than will be applied externally results in no relative movement in the connector and thus no wear of the parts of the connector is experienced.

To have the highest stiffness ratio of the pin to the collet it is suggested that the collet be of a material having a high strength and low modulus of elasticity such as titanium alloy 6A1-4V Beta processed. Titanium is more effective than steel in minimizing the alternating stress component in the collet. The titanium alloy is approximately only sixty percent as heavy as steel and has a coefficient of thermal expansion of the same order of magnitude as steel. The high stiffness ratio of the pin to the collet in the titanium alloy collet design provides a substantial increase in fatigue life.

Thus, the preferred riser connector of the present invention which is heavily preloaded, as suggested, provides risers in which the fatigue life is not limited by the fatigue life of the riser connectors.

The improved tubular connector is herein described as a riser connector but may be used in other applications such as large diameter oil pipe lines subject to high thermal gradients.

What is claimed is:

1. A preloaded tubular connector comprising a first tubular section having an enlargement on one end forming an external shoulder facing away from said one end, a second tubular section adapted to engage with said first tubular section and having a plurality of exterior annular ridges spaced a short distance from said first tubular section, an annular collet having a plurality of axially extending fingers and a base ring with an internal shoulder facing the outer ends of said fingers, each of said fingers having an external loading shoulder facing said base ring and a plurality of internal ridges, said internal collet shoulder engaging said external shoulder of said first tubular section and the internal finger ridges mating with said ridges on said second tubular section, the length of said fingers when unloaded being short of engagement with the mating annular ridges on said second tubular section with said base ring shoulder in engagement with said first tubular section shoulder and sufficiently long for such mating engagement when said tubular connector is preloaded, a lock ring having a depending outer skirt surrounding the exterior of the end of said fingers to retain said finger ridges in engagement with said section ridges, a lock nut threaded on the exterior of said second tubular section and engaging said lock ring to hold said lock ring in position surrounding the ends of said fingers, the mating surfaces on the exterior of said fingers and the interior of said lock ring skirt being tapered at a selflocking taper angle, and said finger external loading shoulder providing a support area for said collet and said first tubular member for exertion of a preload force during assembly.

2. A connector according to claim 1 wherein said tapers have an included cone angle of approximately 8°.

3. A connector according to claim 1 wherein said annular collet is made from a titanium alloy.

4. A connector according to claim 1 wherein said preload force is approximately 1,500,000 pounds.

5. A connector according to claim 1 wherein said tubular sections and said collet are dimensioned so that the preselected preload force used brings said finger ridges into engagement with the second tubular section ridges.

6. A connector according to claim 1 including at least one annular shim positioned between the external shoulder of said first tubular section and the internal shoulder on said collet to preselect the preload force used to assemble the tubular connector.

* * * * *